US007188581B1

(12) United States Patent
Davis et al.

(10) Patent No.: US 7,188,581 B1
(45) Date of Patent: Mar. 13, 2007

(54) MARINE DRIVE WITH INTEGRATED TRIM TAB

(75) Inventors: Richard A. Davis, Mequon, WI (US); David J. Gruenwald, Butte des Morts, WI (US); John A. Groeschel, Theresa, WI (US); Todd P. Gruenstern, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/255,510

(22) Filed: Oct. 21, 2005

(51) Int. Cl.
*B63B 1/22* (2006.01)

(52) U.S. Cl. ..... 114/285

(58) Field of Classification Search ..... 114/285
See application file for complete search history.

(56) References Cited

U.S. PATENT DOCUMENTS

| | | | | |
|---|---|---|---|---|
| 2,912,955 | A * | 11/1959 | Leipert | 440/55 |
| 5,108,325 | A | 4/1992 | Livingston et al. | |
| 5,230,644 | A | 7/1993 | Meisenburg et al. | |
| 5,366,398 | A | 11/1994 | Meisenburg et al. | |
| 5,386,368 | A | 1/1995 | Knight | |
| 5,403,216 | A | 4/1995 | Salmi et al. | |
| 5,415,576 | A | 5/1995 | Meisenburg et al. | |
| 5,425,663 | A | 6/1995 | Meisenburg et al. | |
| 5,685,253 | A | 11/1997 | Alexander, Jr. | |
| 5,735,718 | A | 4/1998 | Ekwall | |
| 5,755,605 | A | 5/1998 | Äsberg | |
| 6,138,601 | A | 10/2000 | Anderson et al. | |
| 6,142,841 | A | 11/2000 | Alexander et al. | |
| 6,230,642 | B1 | 5/2001 | McKenney et al. | |
| 6,234,853 | B1 | 5/2001 | Lanyi et al. | |
| 6,354,235 | B1 | 3/2002 | Davies | |
| 6,357,375 | B1 | 3/2002 | Ellis | |
| 6,386,930 | B2 | 5/2002 | Moffet | |
| 6,431,928 | B1 | 8/2002 | Aarnivuo | |
| 6,439,937 | B1 | 8/2002 | Mansson et al. | |
| 6,447,349 | B1 | 9/2002 | Fadeley et al. | |
| 6,511,354 | B1 | 1/2003 | Gonring et al. | |
| 6,582,259 | B1 | 6/2003 | Mansson et al. | |
| 6,623,320 | B1 | 9/2003 | Hedlund | |
| 6,638,124 | B2 | 10/2003 | Zoubul et al. | |
| 6,688,927 | B2 | 2/2004 | Aarnivuo | |
| 6,705,907 | B1 | 3/2004 | Hedlund | |

(Continued)

FOREIGN PATENT DOCUMENTS

| | | |
|---|---|---|
| WO | WO 03/042036 | 11/2002 |

(Continued)

OTHER PUBLICATIONS

Marine Technology Society Dynamic Postioning Committee Conference Thrusters Session entitled Compact Azipod® Propulsion on DT Supply Vessls, presented by Strand et al, held in Oslo, Norway, Sep. 18-19, 2001.

(Continued)

*Primary Examiner*—Stephen Avila
(74) *Attorney, Agent, or Firm*—Andrus, Sceales, Starke & Sawall, LLP

(57) ABSTRACT

A marine drive and a marine vessel and drive combination have a trim tab with a forward end pivotally mounted to a marine propulsion device.

2 Claims, 11 Drawing Sheets

U.S. PATENT DOCUMENTS

| | | | | |
|---|---|---|---|---|
| 6,712,654 | B1 | 3/2004 | Putaansuu | |
| 6,783,410 | B2 | 8/2004 | Florander et al. | |
| 6,863,013 | B2 * | 3/2005 | Noyes, Jr. | 114/285 |
| 6,942,531 | B1 | 9/2005 | Fell et al. | |
| 6,952,180 | B2 | 10/2005 | Jonsson et al. | |
| 2002/0197918 | A1 | 12/2002 | Aarnivuo | |
| 2003/0161730 | A1 | 8/2003 | Rydberg et al. | |
| 2003/0166362 | A1 | 9/2003 | Varis | |
| 2003/0230636 | A1 | 12/2003 | Varis | |
| 2004/0014380 | A1 | 1/2004 | Varis et al. | |
| 2004/0149003 | A1 | 8/2004 | Nestvall | |
| 2004/0214484 | A1 | 10/2004 | Ylitalo | |

FOREIGN PATENT DOCUMENTS

| | | |
|---|---|---|
| WO | WO 03/072431 | 2/2003 |
| WO | WO 03/074355 | 3/2003 |
| WO | WO 03/093102 | 4/2003 |
| WO | WO 03/093105 | 4/2003 |
| WO | WO 03/093106 | 4/2003 |
| WO | WO 03/093107 | 4/2003 |
| WO | WO 04/068082 | 1/2004 |
| WO | WO 04/074089 | 2/2004 |
| WO | WO 04/113162 | 4/2004 |

OTHER PUBLICATIONS

Marine Technology Society Dynamic Postioning Committee Conference Thrusters Session entitled New Thruster Concept for Station Keeping and Electric Propulsion, presented by Adnanes et al, held in Helsinki, Finland, Sep. 18-19, 2001.

Department of Marine Technology, Norwegian University of Science and Technology, presentation entitled Dynamically Positioned and Thruster Assisted Positioned Moored Vessels, presented by Professor Asgeir J. Sorensen, held in Trondheim, Norway.

Dec. 2004 Boating Business article entitled Volvo: Changing Boating Forever.

Jan. 2005 Boating Magazine article by David Seidman entitled Short Shafted.

OXTS Inertial+GPS; OXTS—Oxford Technical Solutions—RT3040 (http://oxts.com/product) last visited Sep. 30, 2005.

* cited by examiner

MARINE DRIVE WITH INTEGRATED TRIM TAB

BACKGROUND AND SUMMARY

The invention relates to marine drives and to marine vessel and drive combinations.

Marine drives as well as marine vessel and drive combinations are known in the prior art. Marine vessels may include a trim tab for contact by the water for adjusting vessel attitude and/or altering thrust vectors, or otherwise affecting hydrodynamic operation of the vessel.

The present invention arose during continuing development efforts directed toward marine drives and toward marine vessel and drive combinations.

DETAILED DESCRIPTION

Figure 1:
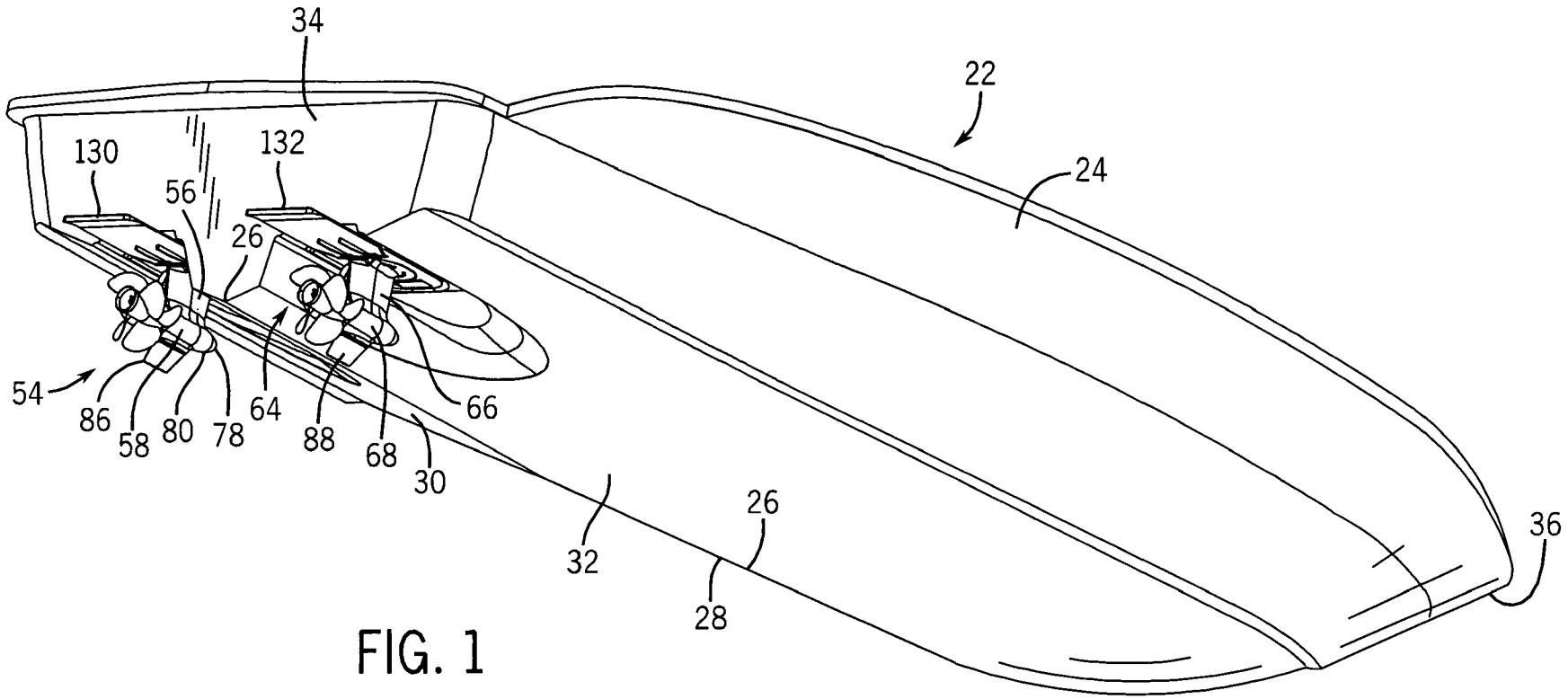
FIG. 1 is a perspective view of a marine vessel and drive combination in accordance with the invention.

FIGS. 1–4 show a marine vessel and drive combination. Marine vessel 22 includes a hull 24 having a longitudinally extending keel 26 having a lower reach 28. The hull has port and starboard lower hull surfaces 30 and 32, respectively, extending upwardly and laterally distally oppositely from keel 26 in V-shaped relation, FIG. 4. Hull 24 extends forwardly from a stem 34 to a bow 36.

Figure 2:
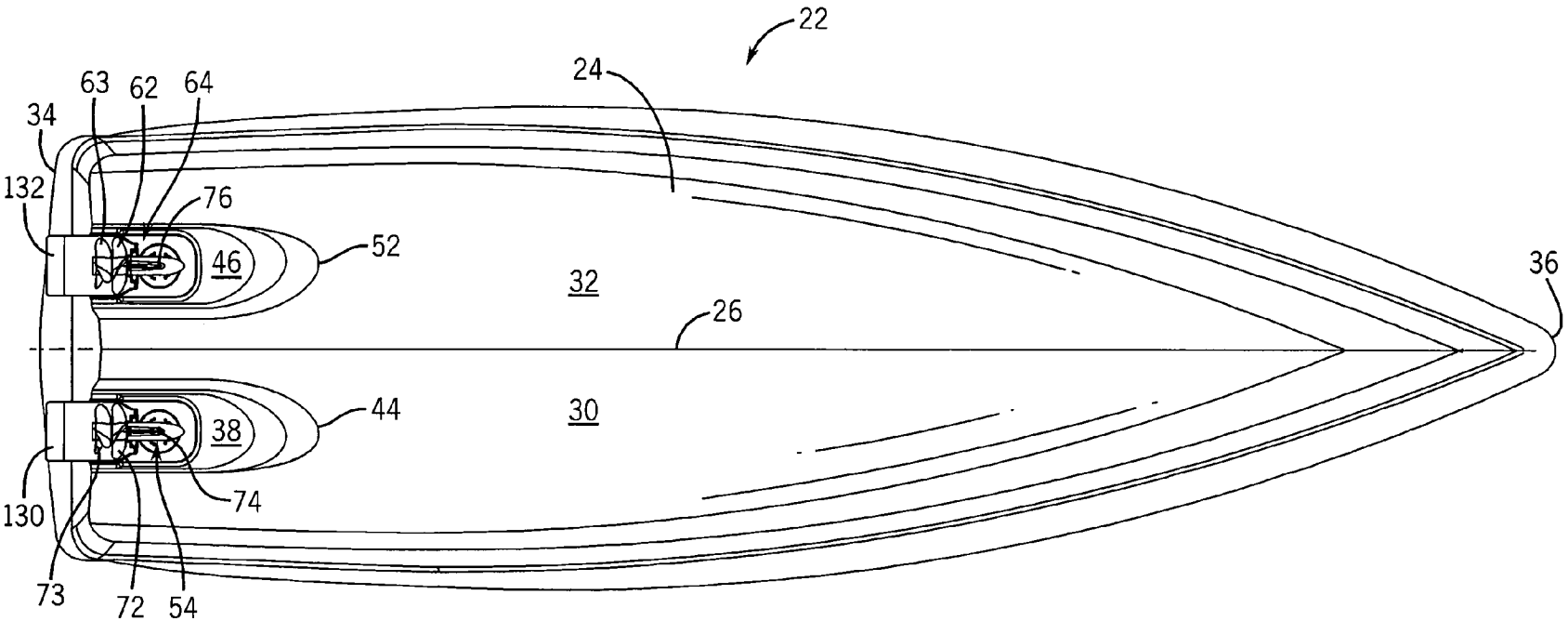
FIG. 2 is a bottom elevation view of the combination of FIG. 1.
Figure 3:
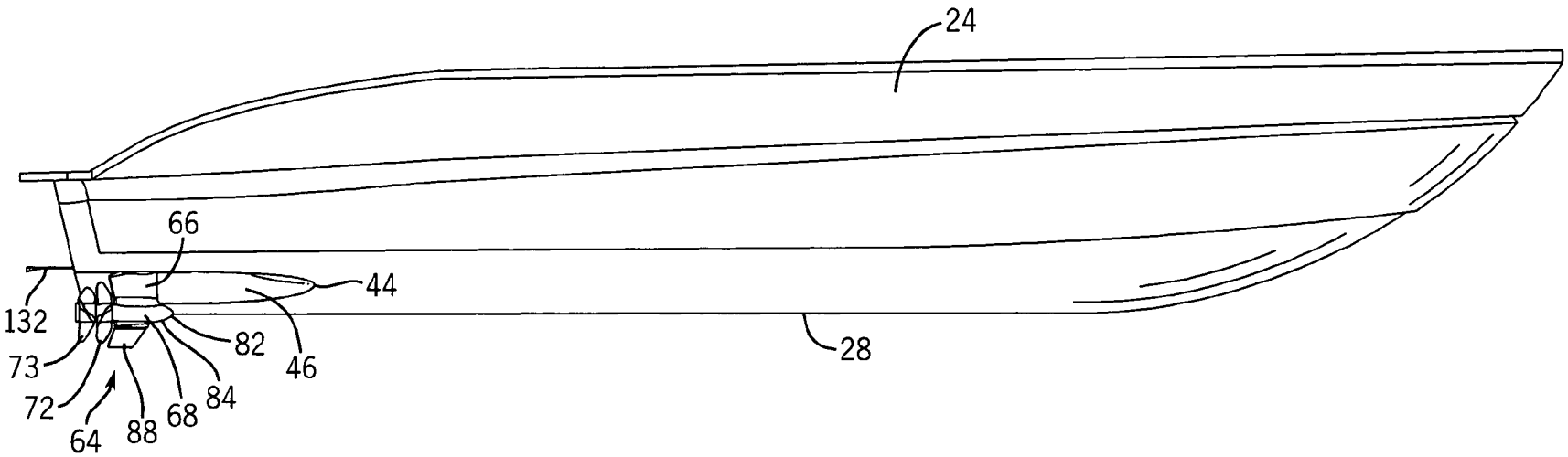
FIG. 3 is a side elevation view of the combination of FIG. 1.

A port tunnel 38, FIG. 2, is formed in port lower hull surface 30. Port tunnel 38 has a top 40, FIG. 4, spaced above an open bottom 42 at port lower hull surface 30. Port tunnel 38 opens aft at stem 34 and extends forwardly therefrom and has a closed forward end 44 aft of bow 36. A starboard tunnel 46 is formed in starboard lower hull surface 32. Starboard tunnel 46 has a top 48 spaced above an open bottom 50 at starboard lower hull surface 32. Starboard tunnel 46 opens aft at stem 34 and extends forwardly therefrom and has a closed forward end 52 aft of bow 36.

A port marine propulsion device 54 includes a port driveshaft housing 56 extending downwardly in port tunnel 38 to a port lower gear case 58, e.g. including a torpedo-shaped housing as is known, supporting at least one port propeller shaft 60 driving at least one water-engaging propulsor such as port propeller 62, and preferably a pair of propeller shafts driving counter-rotating propellers 62, 63, as is known, for example U.S. Pat. Nos. 5,108,325, 5,230,644, 5,366,398, 5,415,576, 5,425,663, all incorporated herein by reference. Starboard marine propulsion device 64 is comparable and includes a starboard driveshaft housing 66 extending downwardly in starboard tunnel 46 to starboard lower gear case 68, e.g. provided by the noted torpedo-shaped housing, supporting at least one starboard propeller shaft 70 driving at least one starboard propeller 72, and preferably a pair of counter-rotating starboard propellers 72, 73, as above. The port and starboard marine propulsion devices 54 and 64 are steerable about respective port and starboard vertical steering axes 74 and 76, comparably as shown in commonly owned co-pending U.S. patent application Ser. No. 11/248,482, filed Oct. 12, 2005, and application Ser. No. 11/248,483, filed Oct. 12, 2005, incorporated herein by reference. Port steering axis 74 extends through the top 40 of port tunnel 38. Starboard steering axis 76 extends through the top 48 of starboard tunnel 46.

Figure 4:
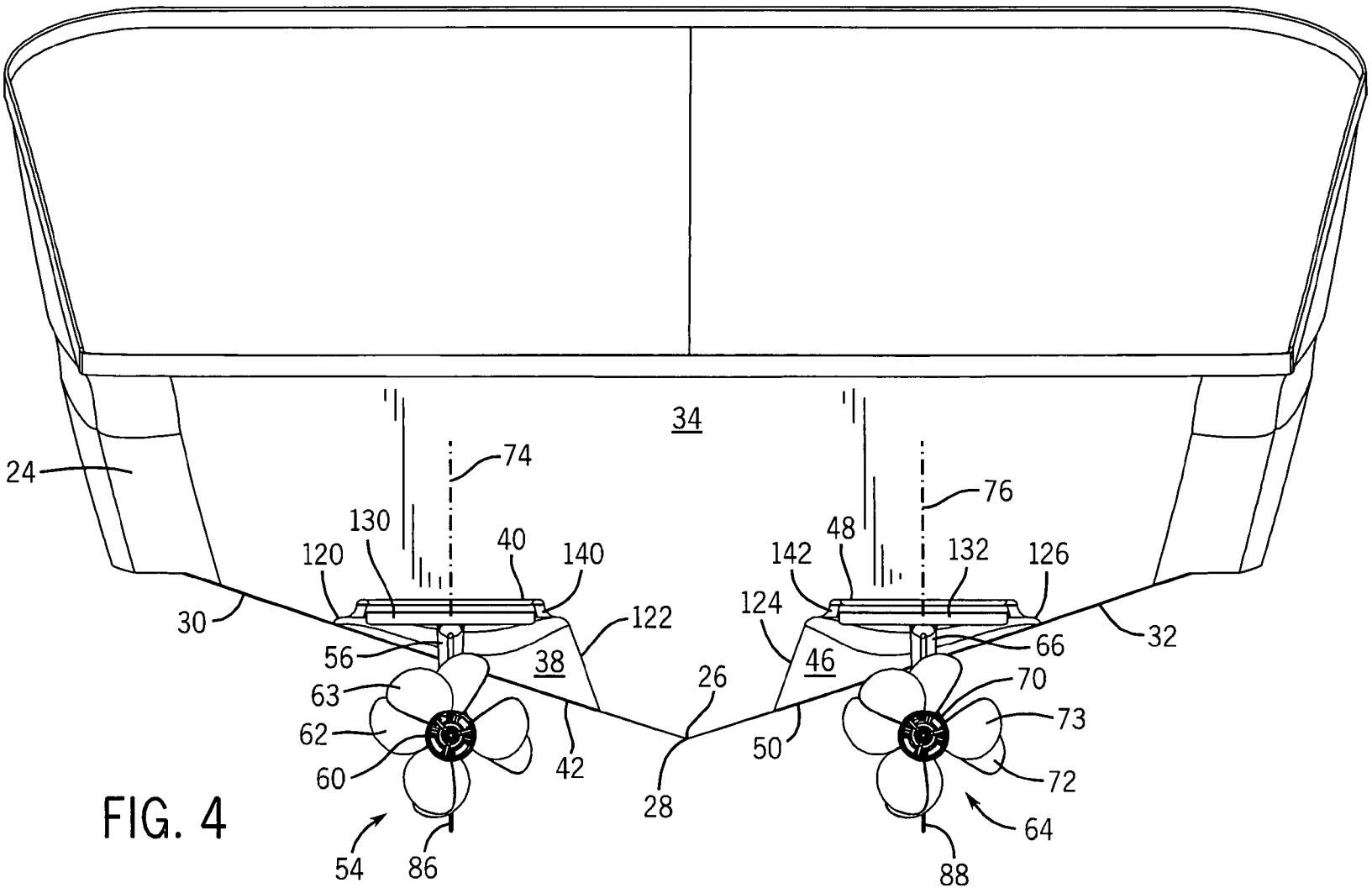
FIG. 4 is a rear or aft elevation view of the combination of FIG. 1.
Figure 5:
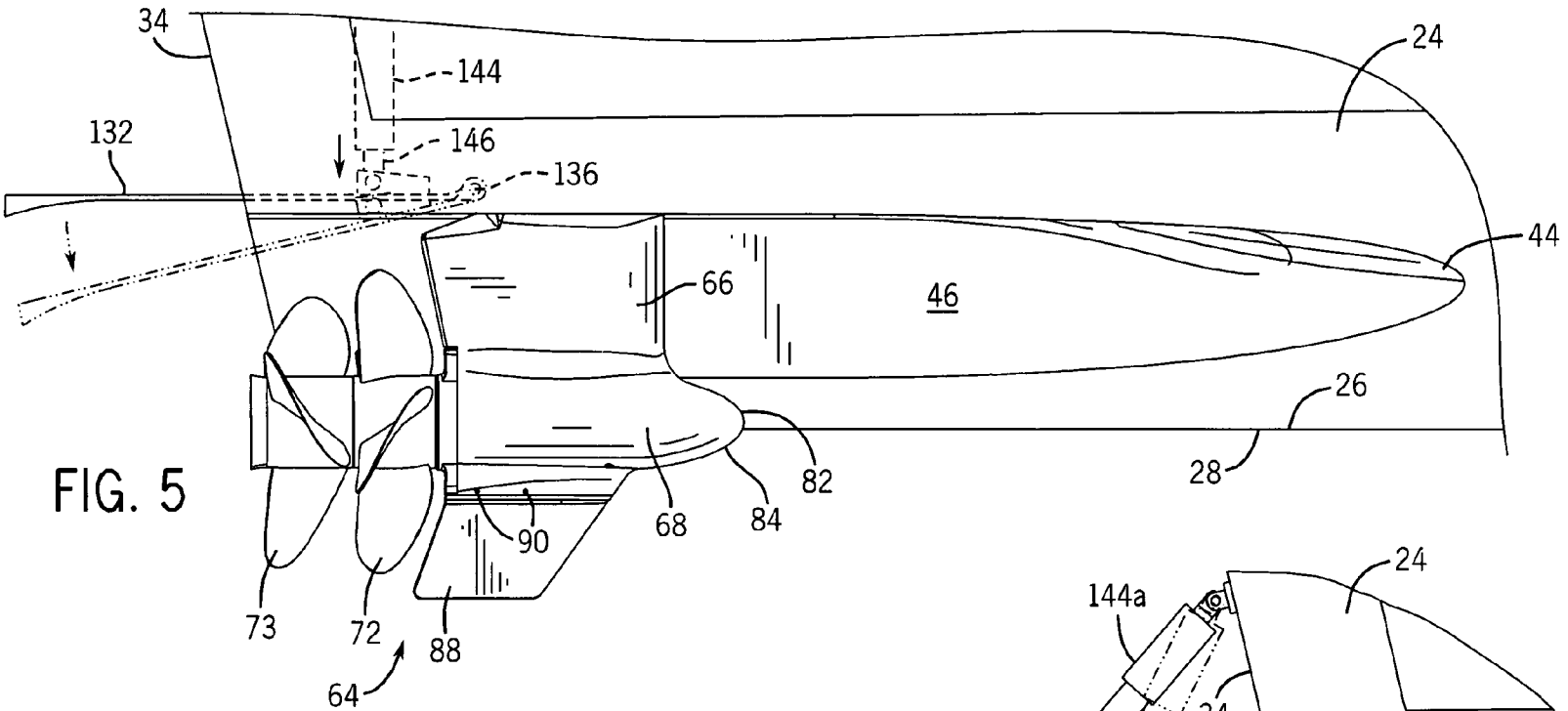
FIG. 5 is an enlarged view of a portion of FIG. 3.
Figure 5A:
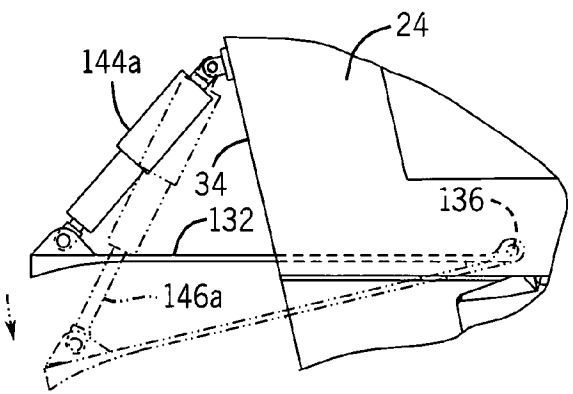
FIG. 5A is like a portion of FIG. 5 and shows an alternate embodiment.
Figure 5B:
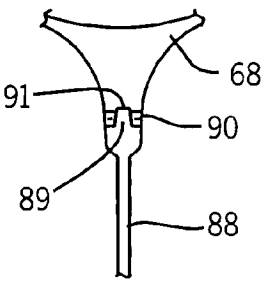
FIG. 5B is an enlarged rear elevation view of a portion of FIG. 5.

Tops 40 and 48 of port and starboard tunnels 38 and 46 are at a given vertical elevation, FIG. 4, spaced vertically above lower reach 28 of keel 26 to provide port and starboard tunnels 38 and 46 with a given vertical height receiving port and starboard marine propulsion devices 54 and 64 and raising same relative to keel 26, such that keel 26 at least partially protects port and starboard marine propulsion devices 54 and 64 from striking underwater objects, including grounding, during forward propulsion of the vessel. At least a portion of port driveshaft housing 56 is in port tunnel 38 and above open bottom 42 of port tunnel 38 at port lower hull surface 30. At least a portion of port lower gear case 58 is outside of port tunnel 38 and below open bottom 42 of port tunnel 38 at port lower hull surface 30. At least a portion of starboard driveshaft housing 66 is in starboard tunnel 46 and above open bottom 50 of starboard tunnel 46 at starboard lower hull surface 32. At least a portion of starboard lower gear case 68 is outside of starboard tunnel 46 and below open bottom 50 of starboard tunnel 46 at starboard lower hull surface 32. In one preferred embodiment, port and starboard lower gear cases 58 and 68 are horizontally aligned along a horizontal projection line at or above and transversely crossing lower reach 28 of keel 26. Port lower gear case 58 includes the noted port torpedo-shaped housing having a front nose 78 with a curved surface 80 extending downwardly and aft therefrom. In one preferred embodiment, front nose 78 is horizontally aligned with lower reach 28 of keel 26, such that underwater objects struck by port lower gear case 58 slide along curved surface 80 downwardly and aft from nose 78 of the noted port torpedo-shaped housing. Starboard lower gear case 68 includes the noted starboard torpedo-shaped housing having a front nose 82, FIG. 5, with a curved surface 84 extending downwardly and aft therefrom. In the noted one preferred embodiment, front nose 82 is horizontally aligned with lower reach 28 of keel 26, such that underwater objects struck by starboard lower gear case 68 slide along curved surface 84 extending downwardly and aft from nose 82 of the noted starboard torpedo-shaped housing. Further in the noted preferred embodiment, port and starboard marine propulsion devices 54 and 64 have respective port and starboard lower skegs 86 and 88 extending downwardly from respective port and starboard lower gear cases 58 and 68 to a lower reach at a vertical level below lower reach 28 of keel 26. Each of port and starboard lower skegs 86 and 88 is a breakaway skeg, e.g. mounted by frangible shear pins such as 90, FIG. 5, to its respective lower gear case, and breaking away from its respective lower gear case upon striking an underwater object, to protect the respective marine propulsion device. FIG. 5B is an enlarged rear elevation view of a portion of skeg 88 and gear case 68 of FIG. 5, with propellers 72 and 73 removed, and showing the mounting of skeg 88 to lower gear case 68 by a breakaway channel or tongue and groove arrangement, for example tongue 89 at the top of skeg 88, and groove or channel 91 at the bottom of lower gear case 68 receiving tongue 89 in breakaway manner upon shearing of frangible pins such as 90.

Figure 6:
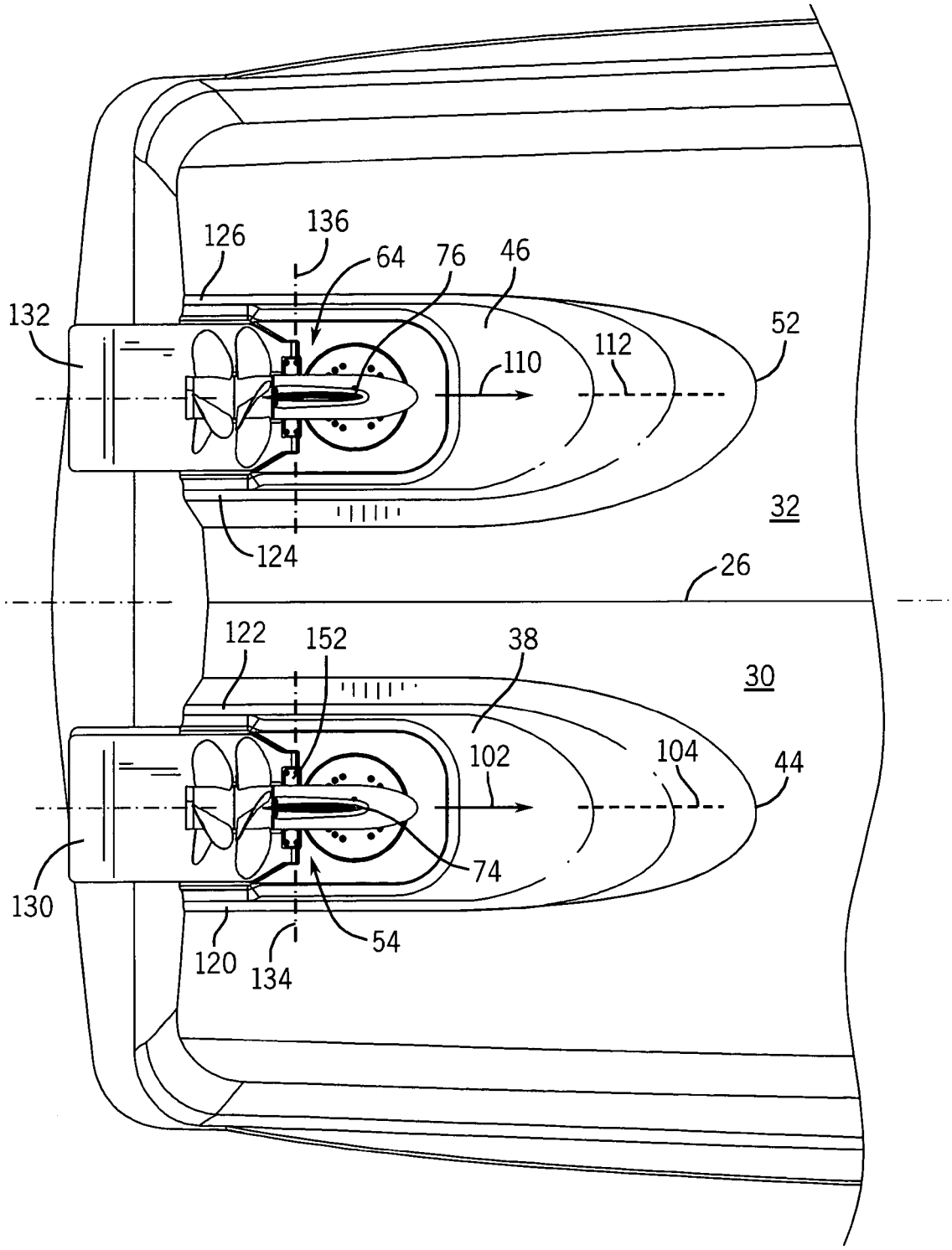
FIG. 6 is an enlarged view of a portion of FIG. 2.
Figure 7:
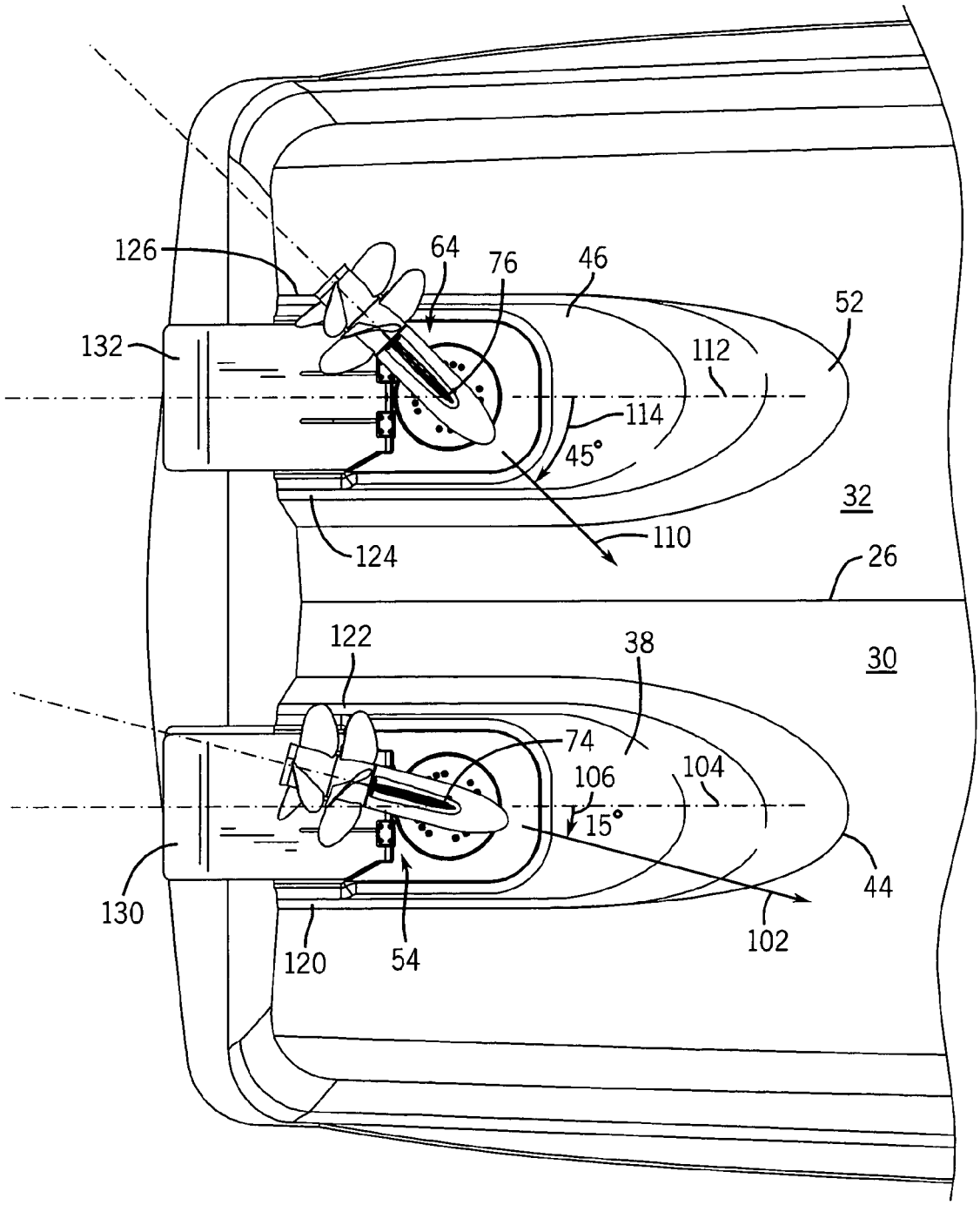
FIG. 7 is like FIG. 6 and shows a different steering orientation.
Figure 8:
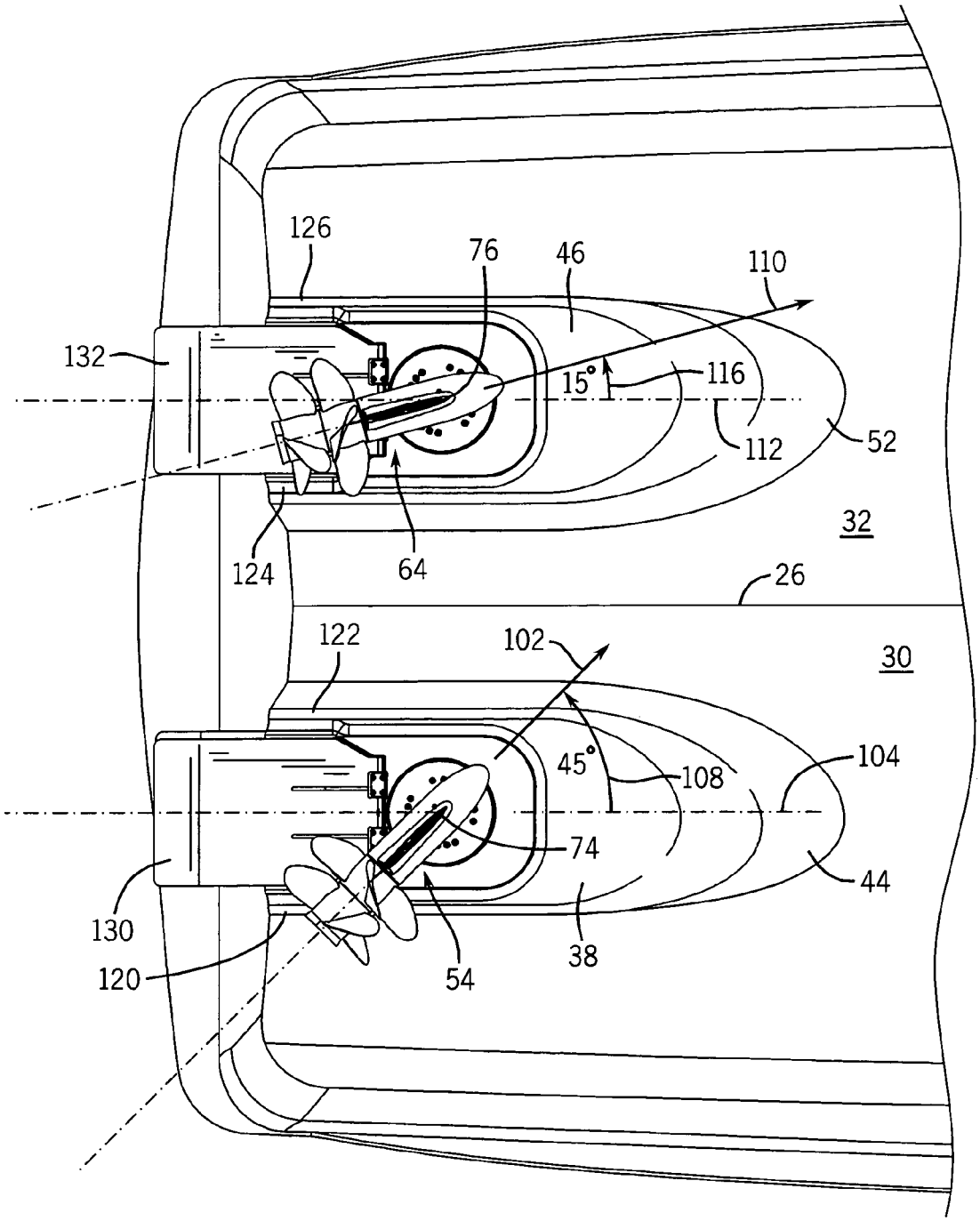
FIG. 8 is like FIG. 6 and shows another different steering orientation.

Port marine propulsion device 54 provides propulsion thrust along a port thrust direction 102, FIG. 6, along the noted at least one port propeller shaft 60. Port marine propulsion device 54 has a port reference position 104 with port thrust direction 102 pointing forwardly parallel to keel 26. Port marine propulsion device 54 is steerable about port steering axis 74 along a first angular range 106, FIG. 7, from port reference position 104 away from keel 26, e.g. clockwise in FIG. 7. Port marine propulsion device 54 is steerable about steering axis 74 along a second angular range 108, FIG. 8, from port reference position 104 towards keel 26, e.g. counterclockwise in FIG. 8. Angular ranges 106 and 108 are unequal, and port tunnel 38 is asymmetric, to be described. Starboard propulsion device 64 provides propulsion thrust along a starboard thrust direction 110 along the noted at least one starboard propeller shaft 70. Starboard marine propulsion device 64 has a starboard reference position 112, FIG. 6, with starboard thrust direction 110 pointing forwardly parallel to keel 26. Starboard marine propulsion device 64 is steerable about starboard steering axis 76 along a third angular range 114, FIG. 7, from starboard reference position 112 towards keel 26, e.g. clockwise in FIG. 7. Starboard marine propulsion device 64 is steerable about starboard steering axis 76 along a fourth angular range 116, FIG. 8, away from keel 26, e.g. counterclockwise in FIG. 8. Third and fourth angular ranges 114 and 116 are unequal, and starboard tunnel 46 is asymmetric, to be described. In one preferred embodiment, second angular range 108 is at least twice as great as first angular range 106, and in a further preferred embodiment, first angular range 106 is at least 15 degrees, and second angular range 108 is at least 45 degrees. In the noted preferred embodiment, third angular range 114 is at least twice as great as fourth angular range 116, and in the noted further preferred embodiment, third angular range 114 is at least 45 degrees, and fourth angular range 116 is at least 15 degrees. Marine propulsion devices 54 and 64 may be rotated and steered in unison with equal angular ranges, or may be independently controlled for various steering, docking, and position or station maintaining virtual anchoring functions, and for which further reference is made to the above-noted commonly owned co-pending '482 and '483 applications Port tunnel 38 has left and right port tunnel sidewalls 120 and 122 extending vertically between top 40 of port tunnel 38 and open bottom 42 of port tunnel 38 and port lower hull surface 30. Left and right port tunnel sidewalls 120 and 122 are laterally spaced by port driveshaft housing 56 therebetween. Right port tunnel sidewall 122 has a greater vertical height and a lower vertical reach than left port tunnel sidewall 120 and limits the span of first angular range 106 to be less than the span of second angular range 108. Starboard tunnel 46 has left and right starboard tunnel sidewalls 124 and 126 extending vertically between top 48 of starboard tunnel 46 and open bottom 50 of starboard tunnel 46 at starboard lower hull surface 32. Left and right starboard tunnel sidewalls 124 and 126 are laterally spaced by starboard driveshaft housing 66 therebetween. Left starboard tunnel sidewall 124 has a greater vertical height and a lower vertical reach than right starboard tunnel sidewall 126 and limits the span of fourth angular range 116 to be less than the span of third angular range 114.

Figure 9:
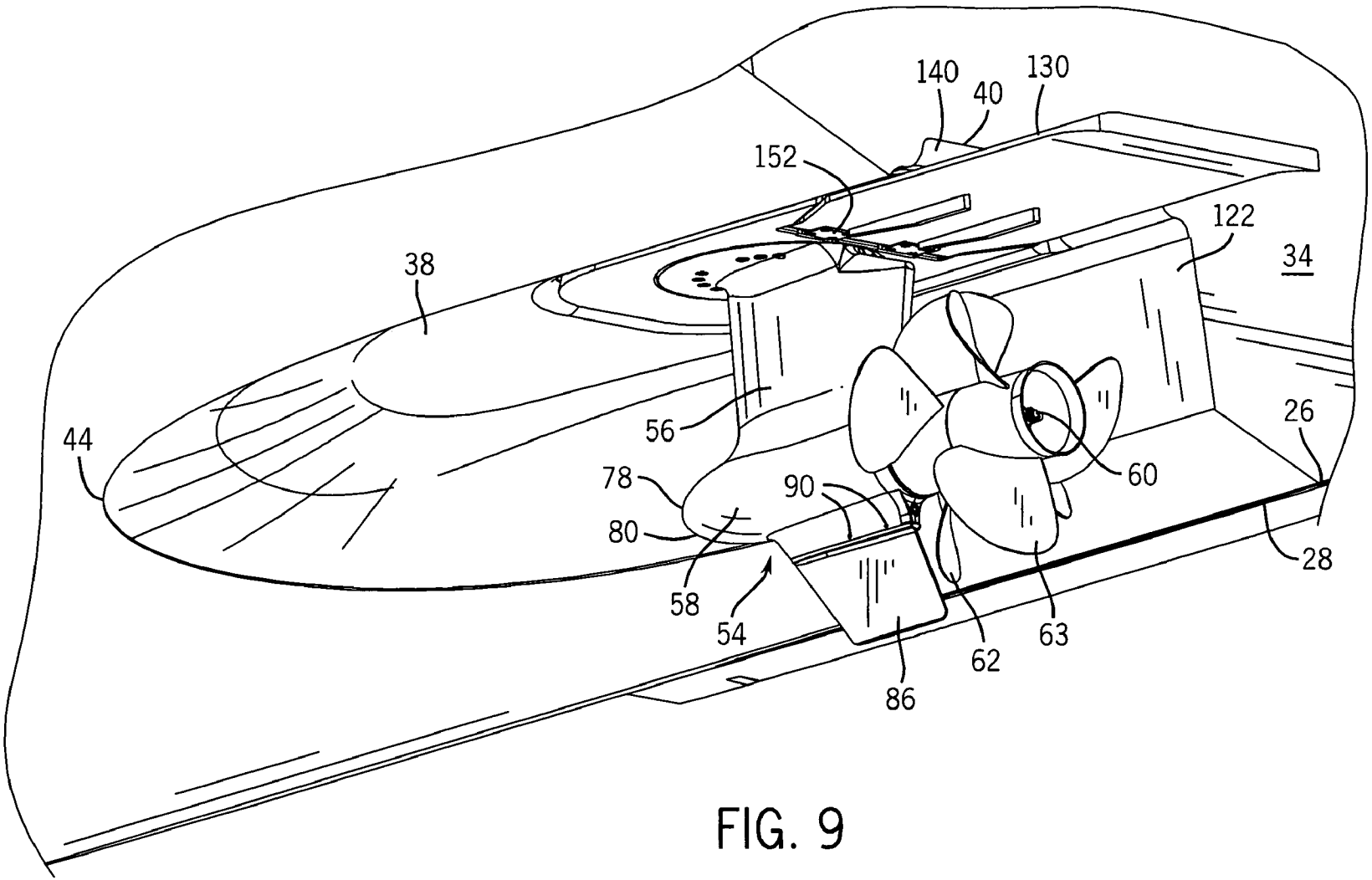
FIG. 9 is an enlarged view of a portion of FIG. 1.
Figure 10:
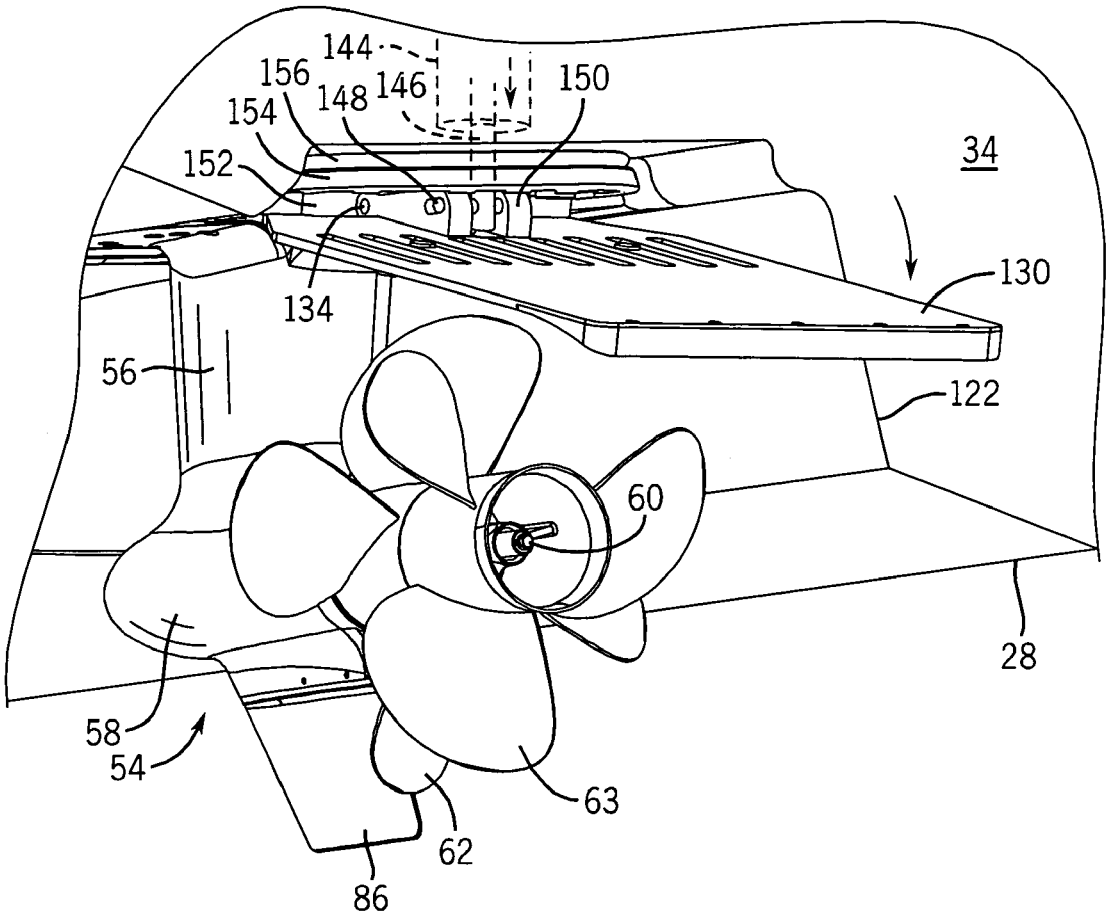
FIG. 10 is like FIG. 9 and shows a further operational embodiment.

Port marine propulsion device 54 has a port trim tab 130 pivotally mounted thereto for contact by the water for adjusting vessel attitude and/or altering thrust vectors or otherwise affecting hydrodynamic operation of the vessel. Starboard marine propulsion device 64 has a starboard trim tab 132 pivotally mounted thereto. Port trim tab 130 is preferably pivotally mounted to port marine propulsion device 54 at a pivot axis 134, FIG. 6, aft of port driveshaft housing 56 and aft of port steering axis 74. Likewise, starboard trim tab 132 is preferably pivotally mounted to starboard marine propulsion device 64 at a pivot axis 136 aft of starboard driveshaft housing 66 and aft of starboard steering axis 76. Port trim tab 130 has an upwardly pivoted retracted position, FIGS. 1, 4, 9, and solid line in FIG. 5, and a downwardly pivoted extended position, FIG. 10, and dashed line in FIG. 5. The top 40, FIG. 4, of port tunnel 38 has a notch 140 receiving port trim tab 130 in the noted retracted position to enhance hydrodynamic profile by providing a smoother transition providing less restriction to water flow therepast. Starboard trim tab 132 likewise has an upwardly pivoted retracted position, and a downwardly pivoted extended position. The top 48 of starboard tunnel 46 has a notch 142 receiving starboard trim tab 132 in the noted retracted position to enhance hydrodynamic profile. Each trim tab may be actuated in conventional manner, e.g. hydraulically, e.g. by a hydraulic cylinder 144 having an extensible and retractable plunger or piston 146 engaging pivot pin 148 journaled to stanchions 150 of the respective trim tab. In an alternate embodiment, FIG. 5A, external hydraulic cylinder 144*a* has its piston 146*a* connected to the aft end of the trim tab, for a longer moment arm from the pivot axis of the trim tab if desired. In further embodiments, the trim tabs may be actuated electrically, e.g. by electrical reduction motors. The forward end of the trim tab is pivotally mounted at hinges such as 152 to mounting plate 154 of the marine propulsion device which is then mounted to the vessel hull and sealed thereto for example at sealing gasket 156. In the preferred embodiment, the forward end of the trim tab is pivotally mounted to the marine propulsion device and not to the vessel, and the aft end of the trim tab is movable in a vertical arc.

Figure 11:
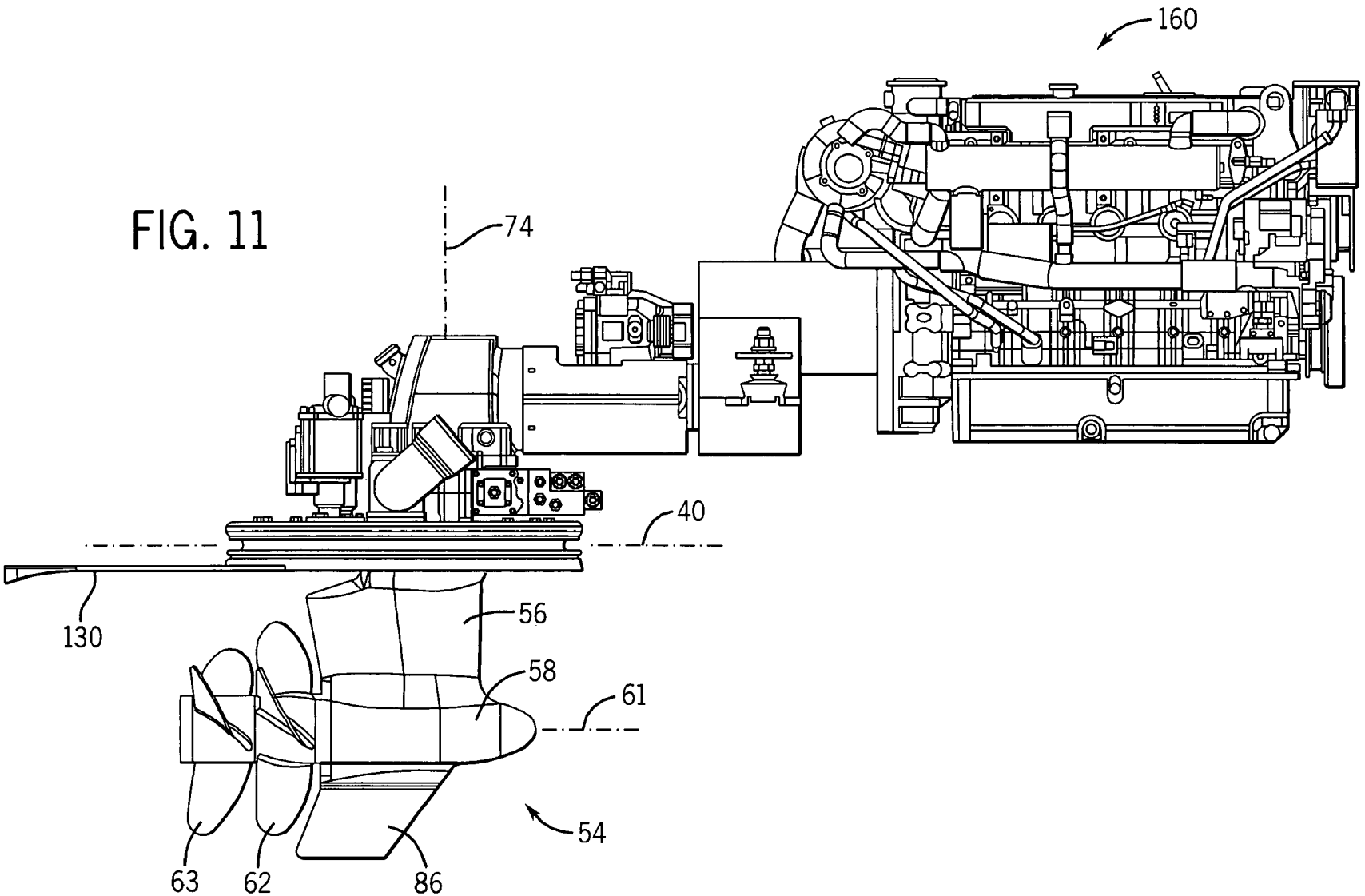
FIG. 11 is a side view showing the arrangement of an engine and marine propulsion device used in conjunction with the present invention.

FIG. 11 is a side view taken from the above-noted commonly owned co-pending '482 and '483 applications and showing the arrangement of a marine propulsion device, such as 54 or 64, associated with a mechanism that is able to rotate the marine propulsion device about its respective steering axis 74 or 76. Although not visible in FIG. 11, the driveshaft of the marine propulsion device extends vertically and parallel to the steering axis and is connected in torque transmitting relation with a generally horizontal propeller shaft that is able to rotate about a propeller axis 61. The embodiment shown in FIG. 11 comprises two propellers 62 and 63, as above noted, that are attached to the propeller shaft 60. The motive force to drive the propellers 62 and 63 is provided by an internal combustion engine 160 that is located within the bilge of the marine vessel 22. The engine is configured with its crankshaft aligned for rotation about a horizontal axis. In one preferred embodiment, engine 160 is a diesel engine. Each of the two marine propulsion devices 54 and 64 is driven by a separate engine 160. In addition, each of the marine propulsion devices 54 and 64 are independently steerable about their respective steering axes 74 and 76. The steering axes are generally vertical and parallel to each other. They are intentionally not configured to be perpendicular to the bottom respective surface 30 and 32 of the hull. Instead, they are generally vertical and intersect the respective bottom surface 30 and 32 of the hull at an angle that is not equal to 90 degrees when the bottom surface of the hull is a V-type hull or any other shape which does not include a flat bottom. Driveshaft housings 56 and 66 and gear case torpedo housings 58 and 68 contain rotatable shafts, gears, and bearings which support the shafts and connect the driveshaft to the propeller shaft for rotation of the propellers. No source of motive power is located below the hull surface. The power necessary to rotate the propellers is solely provided by the internal combustion engine. The marine vessel maneuvering system in one preferred embodiment is that provided in the noted commonly owned co-pending '482 and '483 applications, allowing the operator of the marine vessel to provide maneuvering commands to a microprocessor which controls the steering movements and thrust magnitudes of two marine propulsion devices 54, 64 to implement those maneuvering commands, e.g. steering, docking, and position or station maintaining virtual anchoring functions, and the like, as above noted.

It is recognized that various equivalents, alternatives and modifications are possible within the scope of the appended claims.

What is claimed is:

1. A marine drive for propelling a marine vessel, comprising a marine propulsion device extending from said vessel and having a water-engaging propulsor for propelling, said vessel through a body of water, and a trim tab movably mounted to said marine propulsion device for contact by said water for affecting hydrodynamic operation of said vessel, wherein said trim tab is pivotally mounted to said marine propulsion device, wherein said trim tab has a forward end pivotally mounted to said marine propulsion device, and an aft end movable in a vertical arc, and wherein said marine propulsion device is steerable about a steering axis, and said forward end of said trim tab is pivotally mounted at a pivot axis aft of said steering axis.

2. A marine vessel and drive combination comprising a marine vessel comprising a hull having a longitudinally extending keel having a lower reach, and port and starboard lower hull surfaces extending upwardly and laterally distally oppositely from said keel in V-shaped relation;

a port tunnel formed in said port lower hull surface, said port tunnel having a top spaced above an open bottom;

a starboard tunnel formed in said starboard lower hull surface, said starboard tunnel having a top spaced above an open bottom;

a port marine propulsion device comprising a port driveshaft housing extending downwardly in said port tunnel to a port lower gear case supporting at least one port propeller shaft driving at least one port propeller;

a starboard marine propulsion device comprising a starboard driveshaft housing extending downwardly in said starboard tunnel to a starboard lower gear case supporting at least one starboard propeller shaft driving at least one starboard propeller;

a port trim tab movably mounted to said port marine propulsion device;

a starboard trim tab movably mounted to said starboard marine propulsion device, wherein:

said port driveshaft housing is steerable about a port steering axis which extends through said top of said port tunnel;

said port trim tab is pivotally mounted to said port marine propulsion device at a pivot axis aft of said port steering axis;

said starboard driveshaft housing is steerable about a starboard steering axis which extends through said top of said starboard tunnel;

said starboard trim tab is pivotally mounted to said starboard marine propulsion device at a pivot axis aft of said starboard steering axis;

said port trim tab has an upwardly pivoted retracted position, and a downwardly pivoted extended position;

said top of said port tunnel has a notch receiving said port trim tab in said retracted position to enhance hydrodynamic profile;

said starboard trim tab has an upwardly pivoted retracted position, and a downwardly pivoted extended position;

said top of said starboard tunnel has a notch receiving said starboard trim tab in said retracted position to enhance hydrodynamic profile.

* * * * *